United States Patent [19]

Walker

[11] 3,967,793

[45] July 6, 1976

[54] BARBED WIRE SPOOL HOLDER

[76] Inventor: David O. Walker, Rte. 1, Box 149, Maynard, Ark. 72444

[22] Filed: Apr. 21, 1975

[21] Appl. No.: 569,966

[52] U.S. Cl. ..... 242/96
[51] Int. Cl.[2] ..... B65H 75/40
[58] Field of Search ..... 242/96, 85, 129, 128

[56] References Cited

UNITED STATES PATENTS

| | | | |
|---|---|---|---|
| 3,202,380 | 8/1965 | Hosbein | 242/128 |
| 3,357,654 | 12/1967 | Losman | 242/96 |
| 3,464,647 | 9/1969 | Jacobi | 242/129 |
| 3,815,842 | 6/1974 | Scrogin | 242/96 |
| 3,837,597 | 9/1974 | Boyrhenne | 242/129 |

*Primary Examiner*—Edward J. McCarthy
*Attorney, Agent, or Firm*—Basile and Weintraub

[57] ABSTRACT

A wire spool holder, specifically adapted for barbed wire and the like includes freely rotatable spool engaging members and a freely rotatable holding or grasping member connected to the engaging members.

7 Claims, 3 Drawing Figures

BARBED WIRE SPOOL HOLDER

BACKGROUND OF THE INVENTION

1. Field of the Invention

The present invention pertains to spools of wire and means for holding same. More particularly, the present invention pertains to spool or reel holders for reels of wire and specifically for barbed wire spool holders.

2. Prior Art

Conventionally, wire used in construction, telephone installations and the like is wound on large reels or spools. In using the wire, the spool is normally placed at the work site and the wire is unreeled therefrom, as needed.

Generally, spools of wire are heavy and cumbersome to handle. Thus, the prior art has taught devices for unreeling spools of wire at a construction site and other similar environs. See, inter alia, U.S. Pat. No. 2,935,274; U.S. Pat. No. 3,270,981 and U.S. Pat. No. 3,202,380. Generally speaking, such prior art devices require of themselves, the installation and disassembling thereof with each and every reel of wire which is to be unwound therewith. This necessitates further labor and the attendant costs associated therewith.

With respect to barbed wire, the dangers encountered with the installation and use thereof are well-known and self-evident. In manual installations, spools of barbed wire are unwound and erected by, usually, two or more persons. Because of the hazards encountered with the barbs, one person controls and guides the unreeling of the spool while the other person installs the wire. Such two-man installations are expensive and time consuming. U.S. Pat. No. 2,945,512 teaches a barbed wire laying device which comprises a cart having a spool of barbed wire mounted thereon. Suitable apparatus is mounted on the cart for unwinding the spool and installing the wire. However, the cart involves sufficient mechanical function to render it subject to malfunction, breakdown and the like.

The present invention, on the other hand, provides a device, particularly adapted for barbed wire, which enables the unreeling and installation thereof by a single person, while avoiding the heretofore enumerated problems.

SUMMARY OF THE INVENTION

In accordance with the present invention there is provided a wire spool holder device particulary adapted for use with spools of barbed wire.

The device hereof generally comprises means for engaging a spool of wire and means for grasping or holding the the spool of wire. The means for engaging the spool is freely rotatable to permit the unreeling of the spool. The means for engaging is connected to the means for grasping such that a spool of wire engaged therewith can be held away from the body of the user. The means for grasping is freely rotatable and is interconnected to the means for engaging to permit the free rotation of a spool of wire during the unwinding thereof.

For a more complete understanding of the present invention, reference is made to the following detailed description and accompanying drawing. In the drawing, like reference characters refer to like parts throughout the several views, in which:

DESCRIPTION OF THE PREFERRED EMBODIMENTS

Figure 1:
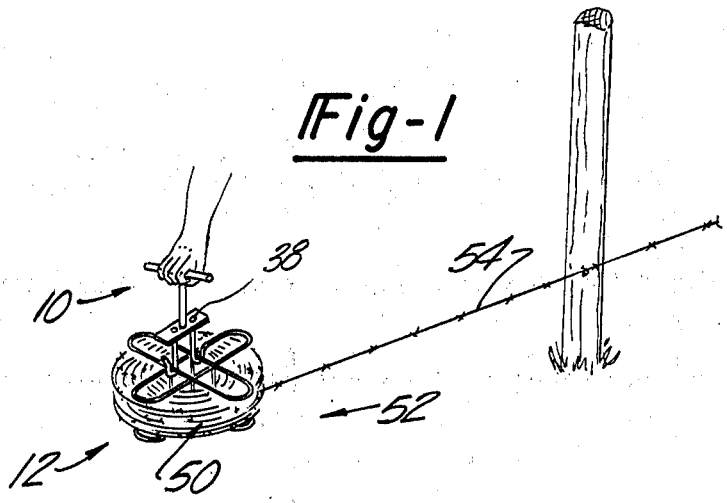
FIG. 1 is an elevational view depicting the use of the present invention.

Now with reference to the drawing, there is depicted therein a wire spool holder in accordance herewith, and generally denoted at 10. The wire spool holder comprises means 12 for engaging a reel or spool of wire and means 14 for manually holding or grasping a spool of wire.

Figure 3:
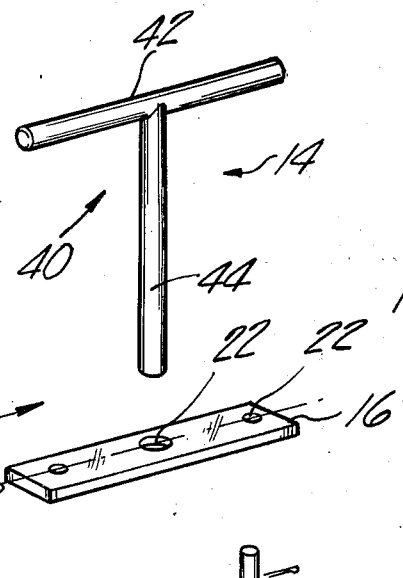
FIG. 3 is a broken, side view, partly in cross-section of the wire spool holder of the present invention.
Figure 3:
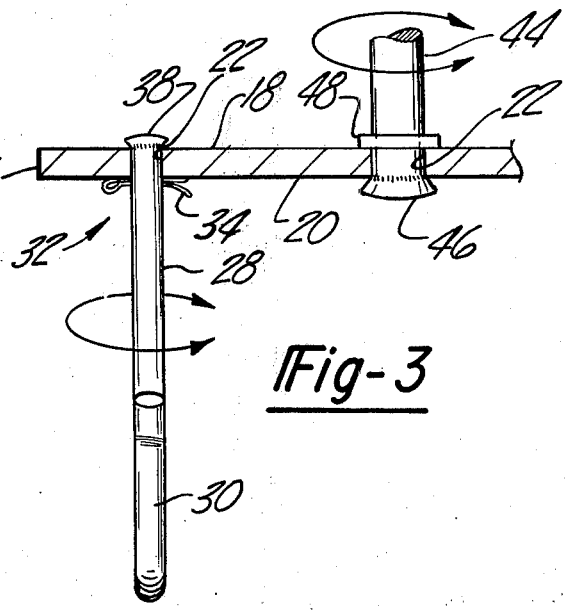
Figure 2:
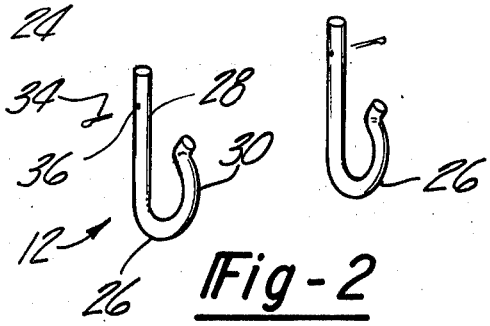
FIG. 2 is an exploded, perspective view of the wire spool holder of the present invention.

With more particularity, and with reference to FIGS. 2 and 3, the device 10 hereof comprises a support member or plate 16. The plate 16 is a substantially linear member having any desired configuration and has a top surface 18 and a bottom surface 20. The support plate is provided with a plurality of apertures or throughbores 22 extending through the top surface 18 and bottom surface 20. To facilitate the manufacture of the present device, the apertures 22, preferably, lie along a common lateral axis 24.

Downwardly depending from the support plate 16 is the reel or spool engaging means 12. The means 12, preferably, comprises a J-shaped hook 26 having a substantially linear portion 28 and an arcuate portion 30. The means 12 is freely rotatably mounted to the support plate 16 about the longitudinal axis thereof, via means, generally indicated at 32.

The means 32 comprises a cotter pin 34 or the like, which extends through the linear portion 28 of the hook 26 via a suitable aperture 36 provided therein. In rendering the means 12 freely rotatable a predetermined length or extent of the linear portion 28 extends through the aperture 22 such that the aperture 36 lies below the bottom surface 20 of the support plate 16. A cap 38 is integrally formed with or otherwise connected to the extent of the linear portion which protrudes above the top surface 18 of the plate 16. The cap 38 has a diameter greater than that of the aperture 22. This prevents the hook from dropping through the aperture 22.

Because the diameter of the linear portion 28 is less than that of the aperture 22, the hook 26 is, thus, freely rotatable about its longitudinal axis.

It is to be appreciated that the engaging means 12 can be rendered freely rotatable in a plurality of ways other than the mode depicted herein. For example, the linear portion 28 of the hook can be journalled in a bearing disposed in the aperture 22 or otherwise associated with the support plate 16. It is to be thus understood, that any mode of rendering the engaging means freely rotatable about the longitudinal axis thereof is contemplated herein.

Referring again to drawing, the present invention further includes means 14 for manually grasping a reel of wire. The means 14 generally comprises a T-shaped member 40 having legs 42, 44 substantially perpendicular to each other. The leg 42 is substantially parallel to the support plate 16. The support plate 16 is freely rotatably mounted about the leg 44 when the leg 44 is stationary. To this end, the lower end 44 is inserted through an aperture 22 provided in the support plate 16. The end of the leg 44 is capped, on the bottom surface 20 of the plate 16, such as by cap 46, in the manner heretofore described. Optimally, a bearing 48 is secured about the periphery of aperture 22 on the top surface 18 of plate 16 and the leg 44 is journalled therethrough, as shown. In this manner, during unwinding of a reel of wire, the plate 16 and the means 12 rotate about the leg 44.

In a preferred embodiment of the invention, and as shown in FIGS. 1 and 2, the spool engaging means 12 comprises a pair of depending freely rotatable hook members 26 which are laterally spaced apart from each other. The means for grasping is, optimally, secured to the support plate between the pair of hook members, as shown.

In utilizing the present device, and as depicted in FIG. 1, the spool engaging means 12 embraces a spool or reel of wire 50. The user then grasps the grasping means 14. To unwind the reel, the wire 50 is moved in the direction of the arrow 52. The rotatability of the means 12 and the plate 16 enables the reel 50 to unwind in a linear length 54 thereof.

It is apparent from the preceding that a spool of wire, and particularly barbed wire, can be handled by a single individual without encountering the dangers associated with such wire. The means for grasping permits the user to maintain a safe distance from the barbs while still being able to unwind the spool.

Having, thus, described the invention, what is claimed is:

1. A wire spool holder device comprising:
   a. means for engaging a spool of wire, the means being freely rotatable about the longitudinal axis thereof, and b. means for grasping a spool of wire interconnected to the means for engaging, the means for grasping being freely rotatable about the longitudinal axis thereof.

2. The device of claim 1 which further comprises:
   a support plate, the means for engaging the wire spool and the means for grasping the wire spool, each being rotatably mounted to the support plate.

3. The device of claim 2 wherein the means for engaging comprises:
   a depending hook, rotatably mounted on the support plate at one end thereof.

4. The device of claim 2 wherein the means for grasping comprises:
   a T-shaped member, one leg of which is rotatably mounted to the support plate.

5. The device of claim 2 wherein the means for engaging comprises a pair of spaced apart depending hooks, each being rotatably mounted to the support plate.

6. The device of claim 1 which further comprises: a support plate, and wherein the means for engaging comprises:
   a. a depending hook rotatably mounted to the support plate at one end thereof, and
   b. the means for grasping comprises:
      a T-shaped member, one leg of which is rotatably mounted to the support plate.

7. The device of claim 6 wherein the means for engaging comprises:
   a. a pair of spaced apart depending hooks, each being rotatably mounted to the support plate.

* * * * *